US008490249B2

(12) United States Patent
Boegel-Poetter et al.

(10) Patent No.: US 8,490,249 B2
(45) Date of Patent: Jul. 23, 2013

(54) HINGE PLATE FOR CONNECTING A LEAF OR A SASH TO A FRAME SO AS TO BE HINGED ABOUT A HINGE AXIS

(75) Inventors: Juergen Boegel-Poetter, Erkelenz (DE); Tibor Herglotz, Kreuzau (DE); Ingo Steinfeld, Langenfeld (DE)

(73) Assignee: Dr. Hahn GmbH & Co. KG, Moenchengladbach-Wickrath (DE)

( * ) Notice: Subject to any disclaimer, the term of this patent is extended or adjusted under 35 U.S.C. 154(b) by 0 days.

(21) Appl. No.: 13/375,486

(22) PCT Filed: May 5, 2010

(86) PCT No.: PCT/EP2010/056075

§ 371 (c)(1),
(2), (4) Date: Dec. 1, 2011

(87) PCT Pub. No.: WO2010/139515

PCT Pub. Date: Dec. 9, 2010

(65) Prior Publication Data

US 2012/0066864 A1 Mar. 22, 2012

(30) Foreign Application Priority Data

Jun. 4, 2009 (DE) ..... 10 2009 025 917

(51) Int. Cl.
*E05D 5/10* (2006.01)

(52) U.S. Cl.
USPC ..... 16/386; 439/31; 439/165

(58) Field of Classification Search
USPC ..... 16/386, 223, 273, 382, 387; 439/31, 439/165; 200/61.7; 361/679.28
See application file for complete search history.

(56) References Cited

U.S. PATENT DOCUMENTS

| | | | | | |
|---|---|---|---|---|---|
| 3,838,234 | A | * | 9/1974 | Peterson | 200/61.7 |
| 3,842,386 | A | * | 10/1974 | Suska | 439/31 |
| 3,848,361 | A | * | 11/1974 | Foster et al. | 49/167 |
| 3,857,625 | A | * | 12/1974 | Crane et al. | 439/31 |
| 4,140,357 | A | * | 2/1979 | Wolz et al. | 439/31 |
| 4,412,711 | A | * | 11/1983 | Suska | 439/31 |
| 5,586,895 | A | * | 12/1996 | Zehrung | 439/165 |
| 5,727,960 | A | * | 3/1998 | Zehrung | 439/165 |
| 7,824,200 | B2 | * | 11/2010 | Bryla et al. | 439/165 |
| 8,307,509 | B2 | * | 11/2012 | Schau | 16/354 |
| 2012/0017396 | A1 | | 1/2012 | Meyer | |

FOREIGN PATENT DOCUMENTS

| | | | |
|---|---|---|---|
| DE | 203 04 980 | U1 | 6/2003 |
| DE | 103 15 208 | A1 | 10/2004 |
| DE | 10 2004 017341 | A1 | 1/2005 |
| DE | 20 2008 014318 | U1 | 4/2010 |
| WO | WO 2010/049292 | A1 | 5/2010 |

* cited by examiner

*Primary Examiner* — William L. Miller
(74) *Attorney, Agent, or Firm* — Norman B. Thot

(57) ABSTRACT

A hinge plate for connecting a leaf of a door to a frame includes a frame hinge plate part comprising a frame fastening part and a frame hinge part. A leaf or sash hinge plate part comprises a leaf or sash fastening part and a leaf or sash hinge part. A primary coil is disposed in the frame hinge part and a secondary coil is disposed in the leaf or sash hinge part, each being configured to surround a hinge plate pin defining a hinge axis. The hinge plate pin is provided as a core for both the primary coil and the secondary coil and is configured to conduct magnetic flux lines. The hinge plate pin comprises a support element configured to transmit a mechanical force between the leaf and the frame. A flux element is configured to conduct the magnetic flux lines between the primary coil and the secondary coil.

17 Claims, 3 Drawing Sheets

HINGE PLATE FOR CONNECTING A LEAF OR A SASH TO A FRAME SO AS TO BE HINGED ABOUT A HINGE AXIS

CROSS REFERENCE TO PRIOR APPLICATIONS

This application is a U.S. National Phase application under 35 U.S.C. §371 of International Application No. PCT/EP2010/056075, filed on May 5, 2010 and which claims benefit to German Patent Application No. 10 2009 025 917.1, filed on Jun. 4, 2009. The International Application was published in German on Dec. 9, 2010 as WO 2010/139515 A1 under PCT Article 21(2).

FIELD

The present invention provides a hinge plate for connecting a leaf of a door or a sash of a window or the like to a frame so as to be hinged about a hinge axis, with a frame hinge plate part, which can be fastened to the frame and which includes a frame fastening part and a frame hinge part, with a leaf or sash hinge plate part, which can be fastened to the leaf or sash and includes a leaf or sash fastening part and a leaf or sash hinge part, and with a hinge plate pin, which defines the hinge axis, wherein a primary coil surrounding the hinge plate pin is disposed in the frame hinge part, wherein a secondary coil surrounding the hinge plate pin is disposed in the leaf or sash hinge part and wherein the hinge plate pin is formed as a core for both coils which conducts magnetic flux lines.

BACKGROUND

Doors for structures such as houses, shops or emergency doors, increasingly have devices which are operated by means of electrical energy for improving safety or convenience.

To supply them with energy, these devices are either galvanically connected, for example, via sliding contacts or flexible cables, to an external energy source, or they have energy stores themselves, for example, rechargeable cells or batteries.

In the first-mentioned case, there is the disadvantage that sliding contacts are susceptible to faults and cable connections significantly impair visual appearance. In the second case, the necessity for separate stores increases operating costs. The space required by the stores moreover impairs functionality and visual appearance.

DE 10 2004 017 341 A1 discloses a hinge plate with a built-in transformer for contactless energy transmission. This hinge plate includes a primary coil disposed in a frame hinge plate part and a secondary coil disposed in a leaf or sash hinge plate part. A hinge plate pin passing through both coils serves for the magnetic coupling of the secondary coil to the primary coil, which are spaced apart from each other in the direction of the hinge axis.

Although the contactless energy transmission from a fixed frame into a leaf or sash disposed pivotably on the frame is in principle desirable to avoid the aforementioned disadvantages, tests have shown that, with the hinge plate disclosed in DE 10 2004 017 341 A1, only very small levels of electrical power can be transmitted from the primary side to the secondary side since the power loss in the transmission is very high.

SUMMARY

An aspect of the present invention is to provide a hinge plate which allows for the contactless transmission of electrical energy to an extent necessary for the operation of commonly-used convenience and safety devices provided on the leaf or sash.

In an embodiment, the present invention provides a hinge plate for connecting a leaf of a door or a sash of a window or the like to a frame so as to be hinged about a hinge axis which includes a frame hinge plate part configured to be fastened to the frame. The frame hinge plate part comprises a frame fastening part and a frame hinge part. A leaf or sash hinge plate part is configured to be fastened to the leaf or sash. The leaf or sash hinge plate part comprises a leaf or sash fastening part and a leaf or sash hinge part. A primary coil is disposed in the frame hinge part and a secondary coil is disposed in the leaf or sash hinge part. The primary coil and the secondary coil are each configured to surround a hinge plate pin defining the hinge axis. The hinge plate pin is provided as a core for both the primary coil and the secondary coil and is configured to conduct magnetic flux lines. The hinge plate pin comprises a support element configured to transmit a mechanical force between the leaf or sash and the frame. A flux element is configured to conduct the magnetic flux lines between the primary coil and the secondary coil.

BRIEF DESCRIPTION OF THE DRAWINGS

The present invention is described in greater detail below on the basis of embodiments and of the drawings in which.

DETAILED DESCRIPTION

Figure 1:
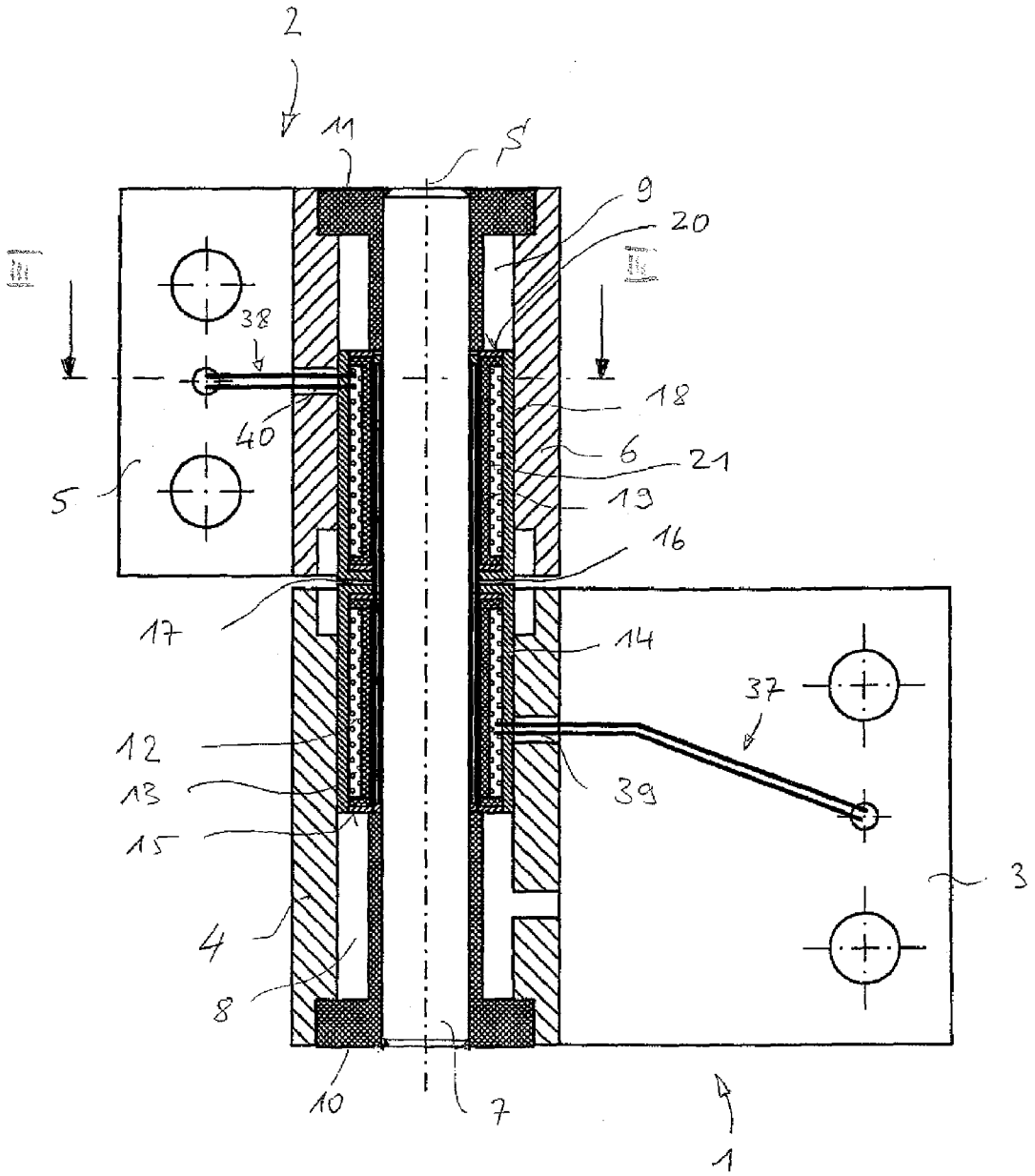
FIG. 1 shows a longitudinal section along the hinge axis of an exemplary embodiment, but without details of the configuration of the hinge plate pin.

In an embodiment of the present invention, the hinge plate pin includes a support element for transmitting mechanical forces between the leaf or sash and the frame and a flux element for conducting magnetic flux lines between the primary and secondary coils. The hinge plate pin consequently has a dual function: on the one hand (as in the case of a conventional hinge plate) it transmits the mechanical forces between the frame and the leaf or sash, on the other hand, it provides an improved magnetic coupling between the primary and secondary coils. Since these two functions are brought about by different elements of the hinge plate pin, the two elements can be especially adapted to the respective function. For the support element, for example, the material may be chosen exclusively on the basis of its mechanical properties. Magnetic properties need not be taken into consideration. For example, steel alloys of sufficient toughness and hardness are suitable, but so too are modern plastics, which may, for example, contain fiber reinforcements. For the flux element, materials with ferromagnetic properties may be used, for example, those with the highest possible permeability.

It has surprisingly been found that, on account of this functional separation, it is possible as a result of the use of suitable materials for the support element and for the flux element to produce hinge plate pins of the same dimensions as in the case of a conventional hinge plate which are suitable for the transmission of forces at the previous level, but on the other hand, have a permeability that leads to a magnetic coupling of the secondary coil to the primary coil which is adequate for the contactless transmission of electrical energy to an extent necessary for the operation of commonly used convenience or safety devices provided on the leaf or sash.

To allow different embodiments for achieving the desired mechanical properties to be realized on the support element, it can be advantageous if the flux element is provided as a material which has ferromagnetic properties and can be processed in a flowable state. The material of the flux element can then, for example, be introduced into recesses, depressions, cavities, etc. of the support element in a flowable state and subsequently cured.

An example of a material which has ferromagnetic properties and can be processed in a flowable state is a sinterable powder material, for example, produced from starting materials such as iron (III) oxide and barium or strontium carbonate. However, it is also possible to produce the flux element from a mixture of ferromagnetic particles, for example, once again from the starting materials iron (III) oxide and barium or strontium carbonate, and to produce a plastics material which can be made to set or sets itself and in which the ferromagnetic particles are then embedded.

This plastics material may be a thermoplastic material. The hinge plate pin is then produced by feeding the thermoplastic material in powder form, provided with the ferromagnetic particles, to the intended locations of the support element of the hinge plate pin, subsequently heating it to above the melting temperature, and finally cooling it down again, or feeding it to these locations of the support element already in a state in which it has been heated above the melting temperature and is flowable.

It is also possible, for example, to use as a curable plastics material a multi-component material or such a material which, for example, cures under the influence of electromagnetic energy and with which the ferromagnetic particles have been admixed before the curing operation.

In an embodiment of the present invention, the plastics material can, for example, also have friction-reducing properties, since in this case it is possible to dispense with bearing bushes that are otherwise often necessary for friction reduction, and the volume otherwise required for the bearing bush is additionally available for the hinge plate pin and/or the coils. Materials such as POM with additions of PTFE or chalk, as well as polyamides with additions of $MoSO_4$ or other sliding-bearing-modifying properties can, for example, be used. In an embodiment of the hinge plate according to the present invention, an elongate component can, for example, be provided for the support element made of a mechanically stable material and connecting the flux element fixedly to the support element in such a way that the lateral surface of the flux element at least partially covers the support element. If made of a material with friction-reducing properties, the flux element can lie against the inner lateral surfaces of the coils without an additional sleeve-shaped sliding element so as to provide a gap that is as small as possible between the flux element and the coil to improve the magnetic coupling.

In order to provide a particularly secure connection between the support element and the flux element, it can be advantageous if the support element includes at least one channel, which runs obliquely in relation to the hinge axis and into which the flux element protrudes, in other words: which is filled with material having ferromagnetic properties. Apart from the improvement in the fastening of the flux element to the support element by the positive connection thereby created, the proportion by volume of the material having ferromagnetic properties in the overall volume of the hinge plate pin is also increased on account of this measure, and its suitability for conducting magnetic flux lines is therefore further improved.

For the further improvement of the magnetic coupling between the coils and the flux element, the flux element may completely surround the support element.

It is also possible to improve the fastening of the flux element to the support element to provide a cage at least partially surrounding the flux element. This cage may be made of a material having friction-reduced properties, and assume the function of a separate sliding sleeve. In this case, the cage can, for example, be embedded in the material of the flux element so as not protrude radially beyond the flux element, or only slightly, in order that the air gap between the coil and the hinge plate pin is as small as possible.

In the case of the embodiment of the hinge plate pin described above, the support element is at least substantially disposed inside the flux element. However, it is likewise possible to provide the flux element in a central volume in the support element. This embodiment of the hinge plate pin may be recommendable if, by contrast with the material used for the support element, the material used for the flux element does not have any material properties suitable for forming the surface of the hinge plate pin and the surface of the hinge plate pin is intended to be formed by the materials of the support element. In this case, however, the coupling between the secondary coil and the primary coil could worsen on account of the greater distance between the interior of the coil and the core formed by the hinge plate pin.

In order to bring about an improvement in this respect, channels which are filled with the material having ferromagnetic properties may be provided so as to extend transversely in relation to the hinge axis from the volume to the lateral surface of the support element. The flux element is then located in a distributed manner over the lateral surface of the hinge plate pin, at least at the locations close to the interior of the coil where the channels pass through the lateral surface of the holding element.

In an embodiment of the hinge plate according to the present invention, which, however, is not restricted to the variant with a hinge plate pin including a support element and a flux element, and to this extent has its own inventive significance independently thereof, at least one of the coils can, for example, includes contact elements which are disposed on an end face and interact with mating contact elements which are disposed on a side of a connecting element that is facing the end face. On account of this measure, the electrical contacting of the coils so configured is made considerably easier, since the coil can first be inserted into the hinge part of the respective hinge plate part without any electrical conduction and the electrical contacting can be brought about by subsequently inserting the connecting element.

The hinge plate denoted as a whole in the drawing by 100 is formed as a so-called two-part hinge plate. It includes a lower frame hinge plate part 1 for mounting the hinge plate 100 on a frame (not represented in the drawing), and an upper leaf or sash hinge plate part 2, on which a leaf or sash (not represented in the drawing) can be mounted. The frame hinge plate part 1 includes a frame fastening part 3 and a frame hinge part 4, the leaf or sash hinge plate part 2 includes a leaf or sash fastening part 5 and a leaf or sash hinge part 6.

The frame hinge plate part 1 and the leaf or sash hinge plate part 2 are connected to each other pivotably about a hinge axis S by means of a hinge plate pin 7, the center longitudinal axis of which coincides with the hinge axis S and consequently defines the latter.

The hinge plate pin 7 passes through the frame hinge part 4 in a hinge plate pin receptacle 8 and the leaf or sash hinge part 6 in a hinge plate pin receptacle 9. A lower bearing bush 10 in the hinge plate pin receptacle 8 and an upper bearing bush 11 in the hinge plate pin receptacle 9 serve for the bearing of the hinge plate pin 7 in the hinge plate pin receptacles 8, 9. The bearing bushes are produced from a friction-reducing plastics material, for example on the basis of POM, as already known for the configuration of such bearing bushes in the case of conventional hinge plates.

Seen from below, the lower bearing bush 10 extends only over part of the length of the hinge plate pin receptacle 8; seen from above, the upper bearing bush 11 accordingly extends only over part of the length of the hinge plate pin receptacle 9. Disposed in the remaining length of the hinge plate pin receptacle 8 is a primary coil 12, the coil winding 13 of which is wound concentrically in relation to the hinge axis S. The coil is singly wound and, depending on the power being transmitted, has at least two winding layers. The coil winding 13 is enclosed by a casing 14. Its outer contour is adapted to the contour of the hinge plate pin receptacle 8 in such a way that the primary coil 12 is accommodated in the frame hinge part 4 in a rotationally fixed manner. The casing is supported with its lower end face 15 on the lower bearing bush 10. The upper end face 16 of the casing 14 forms a rest for the lower end face 17 of a casing 18 of a secondary coil 19, which is mounted in a way corresponding to the primary coil 12 in the hinge plate pin receptacle 9 in the leaf or sash hinge part 6 and is accordingly supported with its upper end face 20 on the upper bearing bush 11. The secondary coil 19 has the same structure as the primary coil 12, it being possible for the coil winding to be formed differently with regard to the number of windings and the dimension of the coil wire used if the electrical energy fed to the primary coil 12 is intended to be transformed in the case of inductive transmission to the secondary coil 19.

Figure 2:
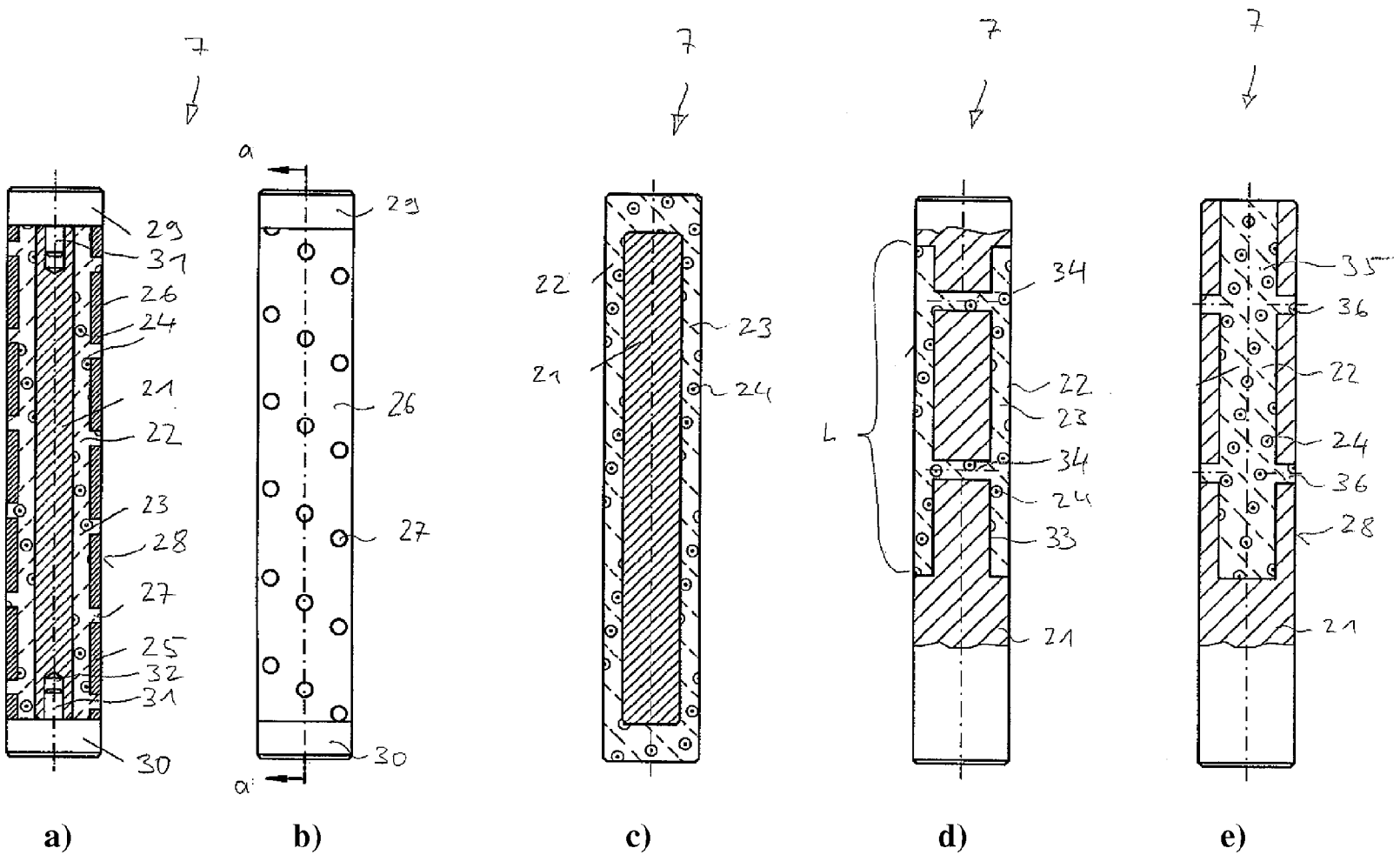
FIGS. 2*a*)-*e*) show various configurations of the hinge plate pin, at least partially in section in the direction of the hinge axis.

In order to improve the inductive coupling between the primary coil 12 and the secondary coil 19, the hinge plate pin 7, which in FIG. 1 is only represented by its contours, includes a support element 21, for transmitting mechanical forces between the leaf or sash and the frame, and a flux element 22, for conducting magnetic flux lines of the primary and secondary coils (see FIG. 2). Various hinge plate pins, which differ in the configuration of the support element 21 and the flux element 22, are represented in FIGS. 2*a*) to *e*).

In the case of the hinge plate pin represented in longitudinal section in FIGS. 2*a*) and *b*), the support element 21 takes the form of a rod. It is provided as a steel alloy with properties which are suitable for the transmission of the forces acting from the leaf or sash to the frame in the case of the respective application. The support element 21 is encapsulated with a thermoplastic material 23, with which particles 24 of ferromagnetic material have been admixed.

In the case of the exemplary embodiment represented in FIG. 2*a*), the plastics material 23 is surrounded by a cage 25, which is made of a friction-reducing plastics material, so as to reduce the friction between the hinge plate pin 7 and the bearing bushes 11, 12 and between the inner lateral surfaces of the casings 14, 18 and the coils. The cage 25 is formed as a sleeve 26 with rows of holes 27. In these holes, the plastics material 23 including the particles 24 reaches as far as the lateral surface 28 of the hinge plate pin, so as to improve the inductive coupling between the flux element 22 and the coils 12, 19.

End pieces 29, 30 form the upper and lower terminations of the embodiment of the hinge plate pin as shown in FIG. 2*a*) and b). For fastening to the support element 21, these end pieces have studs 31, which respectively form a press fit with blind-hole bores 32 of the support element 21.

A further exemplary embodiment of the hinge plate pin 7 is represented in longitudinal section in FIG. 2*c*). In the case of this exemplary embodiment, the support element 21 is completely enclosed by the flux element 22. The flux element is once again made of plastics material 23 with ferromagnetic particles 24. The plastics material is a thermosetting material, for example, based on polyester or epoxy resin, the surfaces of which can be machined after curing.

In the case of the further exemplary embodiment shown partially in longitudinal section in FIG. 2*d*), the hinge plate pin 7 is provided with a flux element 22 only over part of a length. For this purpose, the support element 21 has an annular groove 33, the length L of which corresponds approximately to the length that is covered by the two coils 12, 19. Through-channels 34 are provided in the region of the annular groove; the annular groove 33 and the channels 34 are filled with plastics material 23 mixed with particles 24.

In the case of the further embodiment of the hinge plate pin 7 as shown in FIG. 2*e*), the flux element 22 is provided within a volume 35 which extends at the top over a length of the support element 21 that is covered by the two coils 12, 19. For this purpose, this volume 35 is at least partially filled with ferromagnetic particles 24, which once again may be embedded in a plastics material. Provided to improve the inductive coupling with the coils 12, 19 are channels 36, which reach from the volume 35 to the lateral surface 28 and in which the flux element 22 then once again protrudes as far as the lateral surface 28.

It should be noted that the representation of the plastics material 23 and particles 24 is merely schematic; in particular, the particle size represented and the proportion by volume thereof in relation to the plastics material do not correspond to reality. The particles may be considerably smaller, the proportion by volume thereof in relation to the proportion of plastic may be considerably greater. Furthermore, it is likewise possible to produce the flux elements from ferritic material without embedding particles in a polymer matrix, for example by sintering with a powder material, as long as a sufficiently solid connection of the flux element 22 to the support element is provided.

Figure 3:
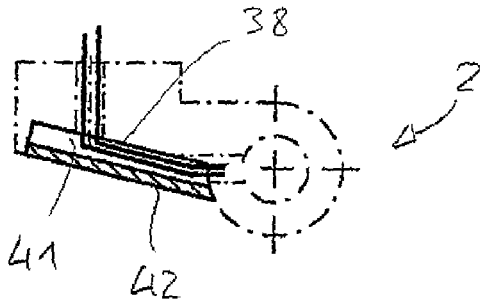
FIG. 3 shows a section along sectional line III-III in FIG. 1.

The two coils 12, 19 may be fixedly provided with electrical connecting lines 37, 38. These may then be led out from the hinge plate pin receptacles 8, 9 through transverse bores 39, 40 in the frame hinge part 4 and the leaf or sash hinge part 6 and led to the frame or the leaf or sash through channels 41 provided in the frame fastening part 3 and the leaf or sash fastening part 5. As can be seen in FIG. 3, the channels 41 can be closed with the aid of a cover 42 so that lines 37, 38 cannot be seen or manipulated from the outside. FIG. 3 only illustrates the routing of the lines on the basis of the leaf or sash hinge plate part 2, but it can be performed in a corresponding way in the case of the frame hinge plate part 1.

Figure 4:
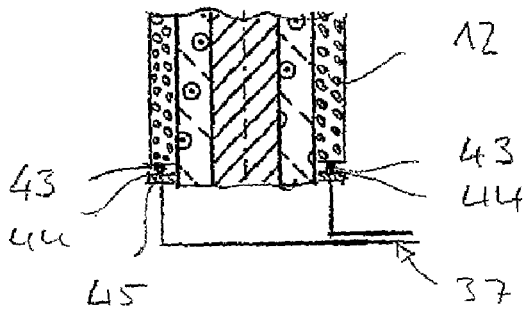
FIG. 4 shows an embodiment of the electrical contacting of a coil in a longitudinal section through the hinge axis.
Figure 5:
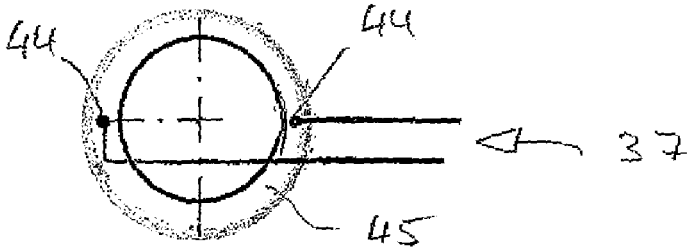
FIG. 5 shows the same electrical contacting in a view from below as shown in FIG. 4.

In particular if the space available for the contacting and the cable routing is limited, the mounting of the coils 12, 19 in the corresponding hinge plate pin receptacles 8, 9 may present difficulties on account of the connecting cables that are fixedly connected to the coils. This can be remedied by the electrical contacting that is shown in FIGS. 4 and 5. In the case of this contacting, the coils, of which only the primary coil 12 is represented by way of example in FIGS. 4 and 5, have on an end face contact elements 43, which in the fitted state interact with mating contact elements 44. The mating contact elements 44 are attached to a connecting element 45, which may have the form of a disk, and are connected in an electrically conducting manner to the electrical lines 37. It goes without saying that this type of contacting may be used independently of the special configuration of the hinge plate pin represented further above, and consequently also has independent inventive significance.

The present invention is not limited to embodiments described herein; reference should be had to the appended claims.

LIST OF DESIGNATIONS

100 hinge plate
1 frame hinge plate part
2 leaf or sash hinge plate part
3 frame fastening part
4 frame hinge part
5 leaf or sash fastening part
6 leaf or sash hinge part
7 hinge plate pin
8 hinge plate pin receptacle
9 hinge plate pin receptacle
10 lower bearing bush
11 upper bearing bush
12 primary coil
13 coil winding
14 casing
15 lower end face
16 upper end face
17 lower end face
18 casing
19 secondary coil
20 upper end face
21 support element
22 flux element
23 plastics material
24 particles
25 cage
26 sleeve
27 holes
28 lateral surface
29 end piece
30 end piece
31 studs
32 blind-hole bores
33 annular groove
34 channels
35 volume
36 channels
37 lines
38 lines
39 transverse bore
40 transverse bore
41 channels
42 cover
43 contact elements
44 mating contact elements
45 connecting element
L length
S hinge axis

What is claimed is:

1. A hinge plate for connecting a leaf of a door or a sash of a window to a frame so as to be hinged about a hinge axis, the hinge plate comprising:

a frame hinge plate part configured to be fastened to the frame, the frame hinge plate part comprising a frame fastening part and a frame hinge part;

a leaf or sash hinge plate part configured to be fastened to the leaf or sash, the leaf or sash hinge plate part comprising a leaf or sash fastening part and a leaf or sash hinge part; and a primary coil disposed in the frame hinge part and a secondary coil disposed in the leaf or sash hinge part, the primary coil and the secondary coil each surrounding a hinge plate pin defining the hinge axis;

wherein the hinge plate pin is provided as a core for both the primary coil and the secondary coil and to conduct conduct magnetic flux lines, and the hinge plate pin comprises a support element which transmits a mechanical force between the leaf or sash and the frame, and a flux element which conduct the magnetic flux lines between the primary coil and the secondary coil.

2. The hinge plate as recited in claim 1, wherein the flux element comprises a material having ferromagnetic properties.

3. The hinge plate as recited in claim 2, wherein the flux element is produced from a sinterable powder material.

4. The hinge plate as recited in claim 2, wherein the flux element comprises a mixture of ferromagnetic particles and a plastics material.

5. The hinge plate as recited in claim 4, wherein the plastics material is a thermoplastic material.

6. The hinge plate as recited in claim 4, wherein the plastics material is a multi-component material.

7. The hinge plate as recited in claim 4, wherein the plastics material has a friction-reducing property.

8. The hinge plate as recited in claim 4, wherein the mixture of ferromagnetic particles and a plastics material is solidifiable or solidifies itself.

9. The hinge plate as recited in claim 2, wherein the material having ferromagnetic properties is processed in a flowable state.

10. The hinge plate as recited in claim 1, wherein the support element is an elongated component provided as a mechanically stable material, the flux element is a component fixedly connected to the support element, and the support element at least partially covers a lateral surface of the flux element.

11. The hinge plate as recited in claim 10, wherein the support element comprises at least one channel running obliquely with respect to the hinge axis, the at least one channel being filled with a material having ferromagnetic properties.

12. The hinge plate as recited in claim 10, wherein the flux element completely surrounds the support element.

13. The hinge plate as recited in claim 10, further comprising a cage which at least partially surrounds the flux element.

14. The hinge plate as recited in claim 13, wherein the cage comprises a material having a friction-reducing property.

15. The hinge plate as recited in claim 1, wherein the support element comprises a central volume extending in a direction of the hinge axis, the central volume being filled with a material having ferromagnetic properties.

16. The hinge plate as recited in claim 15, further comprising at least one channel filled with a material having ferromagnetic properties, the at least one channel extending transversely with respect to to the hinge axis from the central volume to a lateral surface of the support element.

17. A hinge plate for connecting a leaf of a door or a sash of a window to a frame so as to be hinged about a hinge axis, the hinge plate comprising:

a frame hinge plate part configured to be fastened to the frame, the frame hinge plate part comprising a frame fastening part and a frame hinge part;

a leaf or sash hinge plate part configured to be fastened to the leaf or sash, the leaf or sash hinge plate part comprising a leaf or sash fastening part and a leaf or sash hinge part; and a primary coil disposed in the frame hinge part and a secondary coil disposed in the leaf or sash hinge part, the primary coil and the secondary coil each surrounding a hinge plate pin defining the hinge axis;

wherein the hinge plate pin is provided as a core for both the primary coil and the secondary coil and which conducts magnetic flux lines, the hinge plate pin comprises a support element which transmits a mechanical force between the leaf or sash and the frame, and a flux element which conducts the magnetic flux lines between the primary coil and the secondary coil, and at least one of the primary coil and the secondary coil comprises contact elements disposed on an end face, the contact elements interacting with mating contact elements disposed on a side of a connecting element facing the end face.

* * * * *